US006570136B1

(12) United States Patent
Lockwood et al.

(10) Patent No.: US 6,570,136 B1
(45) Date of Patent: May 27, 2003

(54) TOP-HEAT OVEN WITH SELECTIVE BROWNING

(75) Inventors: John W. Lockwood, St. Joseph, MI (US); James Pyles, Enon, OH (US); Barbara A. Hodson, Troy, OH (US); Karen M. Embury, St. Joseph, MI (US); Madelyn A. Cook, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 10/063,983

(22) Filed: May 31, 2002

(51) Int. Cl.[7] ..... A21B 1/22; A21B 1/14; H05B 1/02

(52) U.S. Cl. ..... 219/398; 219/411; 219/412; 219/492

(58) Field of Search ..... 219/398, 411, 219/412, 395–397, 492, 494, 507–510

(56) References Cited

U.S. PATENT DOCUMENTS

| | | | | | |
|---|---|---|---|---|---|
| 3,751,632 | A | * | 8/1973 | Kauranen | 219/492 |
| 4,164,643 | A | * | 8/1979 | Peart et al. | 219/411 |
| 4,441,015 | A | * | 4/1984 | Eichelberger et al. | 219/411 |
| 5,280,157 | A | * | 1/1994 | Hornung | 219/398 |
| 5,695,668 | A | * | 12/1997 | Boddy | 219/399 |
| 5,736,713 | A | * | 4/1998 | Westerberg | 219/411 |
| 6,114,663 | A | * | 9/2000 | Stockley | 219/398 |
| 6,222,163 | B1 | * | 4/2001 | Arntz et al. | 219/494 |
| 6,337,468 | B1 | * | 1/2002 | Worthington et al. | 219/508 |
| 6,355,914 | B1 | * | 3/2002 | Stockley | 219/398 |

* cited by examiner

*Primary Examiner*—Joseph Pelham
(74) *Attorney, Agent, or Firm*—Thomas J. Roth; Robert O. Rice; John F. Colligan

(57) ABSTRACT

A dual-heating element oven comprising a bake heating element and a broil heating element in combination with a control system that permits the selective alteration of the output of the broil heating element by the user to control the browning of a food item during the bake cycle.

45 Claims, 11 Drawing Sheets

TOP-HEAT OVEN WITH SELECTIVE BROWNING

BACKGROUND OF INVENTION

1. Field of the Invention

In one aspect, the invention relates to an oven for baking food items, and more specifically, to an oven capable of selectively browning a food item.

2. Description of the Related Art

Electric and gas cooking ovens are old and well-known. They comprise a chassis in which is located a baking cavity having one or more racks for supporting a food item. Such ovens initially used a single heating element located in the bottom of the baking cavity, which is known as the bake heating element. The heat from the bake heating element would travel to the top of the baking cavity, predominately by convection. A disadvantage of the single element was that a temperature gradient can develop between the bottom and the top of the oven because of the time that it took for the heat to travel to the top of the cavity. The magnitude of the temperature gradient is exacerbated by the use of a cooking dish which typically covered a large portion of the baking cavity cross section and disrupted the flow of heat from the bottom to the top of the baking cavity. The presence of the pan tended to create an airflow stagnation location at the bottom of the pan and forced the heated air to the perimeter of the baking cavity, which resulted in a dead heating zone directly above the dish where the air has a lower temperature. The temperature gradient with and without the dish was often substantial enough to adversely affect the baking performance of the oven.

One popular solution to eliminating the temperature gradient was to use a second heating element in the top of the oven. Such heating elements are also used to broil foods by directly radiating heat onto the upper surface of the food item. These heating elements are generally referred to as "broil heating elements" even when used during baking because of their initial historical use for broiling.

A disadvantage of the using the broil heating element during baking is that the food item receives a much larger amount of directly radiated heat (top heat) from the broil heating element. The amount of radiated heat is attributable to the close proximity of the broil heating element to the upper surface of the food item, and the upper surface of the food item is not protected from direct radiation like the bottom surface, which is normally protected by a pan or some other covering to prevent dripping.

The extra top heat increases the rate and degree of browning of the food item as compared to when only the bake heating element is used. The extra top heat, while greatly beneficial for maintaining a more even temperature distribution in the oven resulting in a reduced temperature gradient and in better baking performance, is not useful for food items that require browning, like pies, cookies and the like.

There is still a need for an oven that has the even temperature distribution associated with dual heating elements yet maintains the browning performance of the single heating element.

SUMMARY OF INVENTION

The invention solves the problem of providing user control of the top-heat radiated by an oven by permitting the user to selectively increase or decrease the radiated top heat.

The decrease in radiated top heat is especially important in enhancing the browning performance problem of a dual-heating-element oven. The invention relates to an oven for baking food according to a bake cycle, which typically has a user select time and temperature parameters. The oven comprises a housing that defines an open-faced baking cavity, which is formed by opposing top and bottom walls, opposing sidewalls that extend between the top and bottom walls, and a rear wall opposing the open face. A door is movably mounted to the housing for movement between an opened to a closed position to thereby selectively close the baking cavity open face. A bake heating element is positioned adjacent the bottom wall for introducing heat energy ("bottom heat") into the baking cavity. A broil heating element is positioned adjacent the top wall for introducing heat energy ("top heat") into the top of the baking cavity. A controller is provided for controlling the activation of the top heating element by cycling the broil heating element ON and OFF to implement the bake cycle. The controller has a user-operable switch, the selection of which reduces/increases the top heat radiated by the broil heating element while the switch is selected. The deselection of the switch terminates the reduced/increased top heat. The selection and deselection of the switch permits the user to selectively control the top heat and thus control the browning performance of the oven.

The controller can control the activation of both the broil and the bake heating elements by cycling the broil and bake elements ON and OFF according to a predetermined protocol to implement the bake cycle according to the user-selected time and temperature. The selection of the user-operable switch reduces/increases the top heat radiated by the broil heating element relative to top heat output according to the predetermined protocol.

The reduction/increase of the top heat radiated by the broil heating element can be accomplished in a variety of different ways. For example, the selection of the user-operable switch can reduce/increase the overall time that the broil heating element is on relative to the overall time the broil heating element would be on under the predetermined protocol. The reduced/increased time that the broil heating element is on can be accomplished by either reducing/increasing a broil temperature set point for the broil heating element or reducing/increasing the duty cycle for the broil heating element, as compared to the duty cycle under the predetermined protocol. The reduction/increase of the broil temperature set point and the duty cycle can be combined to reduce/increase the top heat output of the broil heating element.

The invention also relates to a method for controlling the browning performance of an oven comprising a baking cavity having a broil heating element positioned near the top wall of the oven cavity for radiating top heat into the baking cavity, a bake heating element positioned near a bottom wall of the baking cavity for radiating bottom heat into the baking cavity, and a controller for actuating the bake and broil heating elements ON and OFF. The method comprises implementing a baking cycle that maintains a temperature of the baking cavity at a predetermined bake temperature by controlling the cycling of the bake and broil heating elements and selectively reducing/increasing the cumulative top heat radiated by the broil heating element for at least part of the bake cycle in response to a user input.

The top heat radiated by the broil heating element can be reduced/increased for the entire bake cycle in response to the user input. Also, the predetermined bake temperature is typically selected by the user.

The implementation of the bake cycle comprises having a broil temperature set point corresponding to the predetermined bake temperature. The selective reduction/increase of top heat can be accomplished by reducing/increasing the broil temperature set point. Also, the implementation of the bake cycle can further comprise adding a duty cycle for the broil heating element based on the predetermined bake temperature.

The duty cycle can vary as a function of the magnitude of the predetermined bake temperature. The predetermined bake temperature can also be limited to at least two temperature ranges, with the duty cycle varying as a function of the temperature range. The reduction of the broil temperature set point can also vary as a function of the temperature range.

In another aspect, the invention relates to an oven for baking food according to a bake cycle having user selected time and temperature parameters. The oven comprises a housing that defines a baking cavity in which a bake heating element is positioned adjacent a lower portion of the baking cavity for introducing bottom heat into the baking cavity and a broil heating element positioned adjacent an upper portion of the baking cavity for introducing top heat into the baking cavity. A control panel is provided comprising a bake mode selector for selecting the desired bake mode, a bake temperature selector for selecting the desired baking temperature, a bake time selector for selecting the desired bake time, and a top heat adjustment selector for adjusting the top heat relative to the amount of top heat determined by the selected bake mode. The selection of the top heat adjustment selector on the control panel can increase or decrease the outputted top heat relative to the outputted top heat according to the selected bake mode.

DETAILED DESCRIPTION

Figure 1:
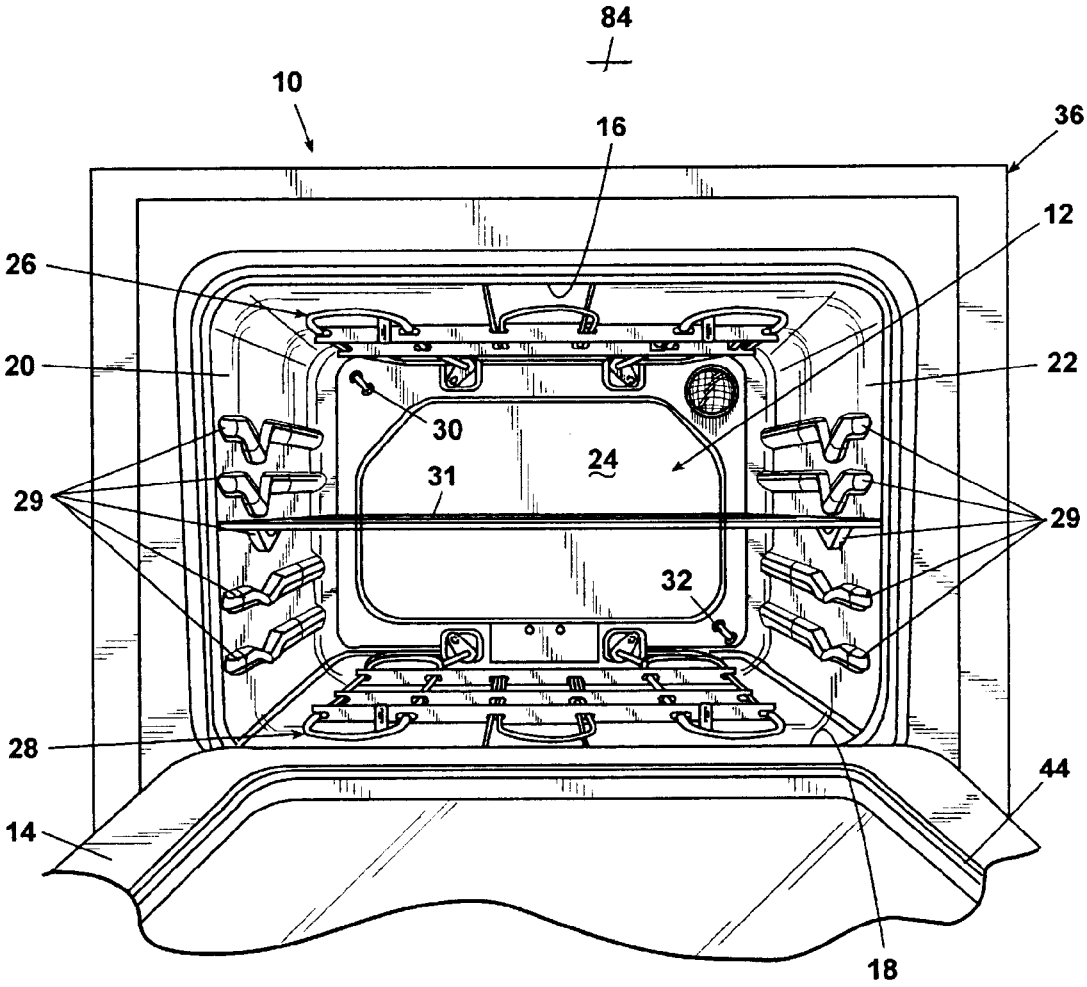
FIG. 1 is a perspective view looking into the baking cavity for an oven according to the invention having a broil heating element at the top of the baking cavity and a bake heating element located at the bottom portion of the baking cavity and dual temperature sensors, with one temperature sensor located near the broil heating element and the other located near the bake heating element.
Figure 1A:
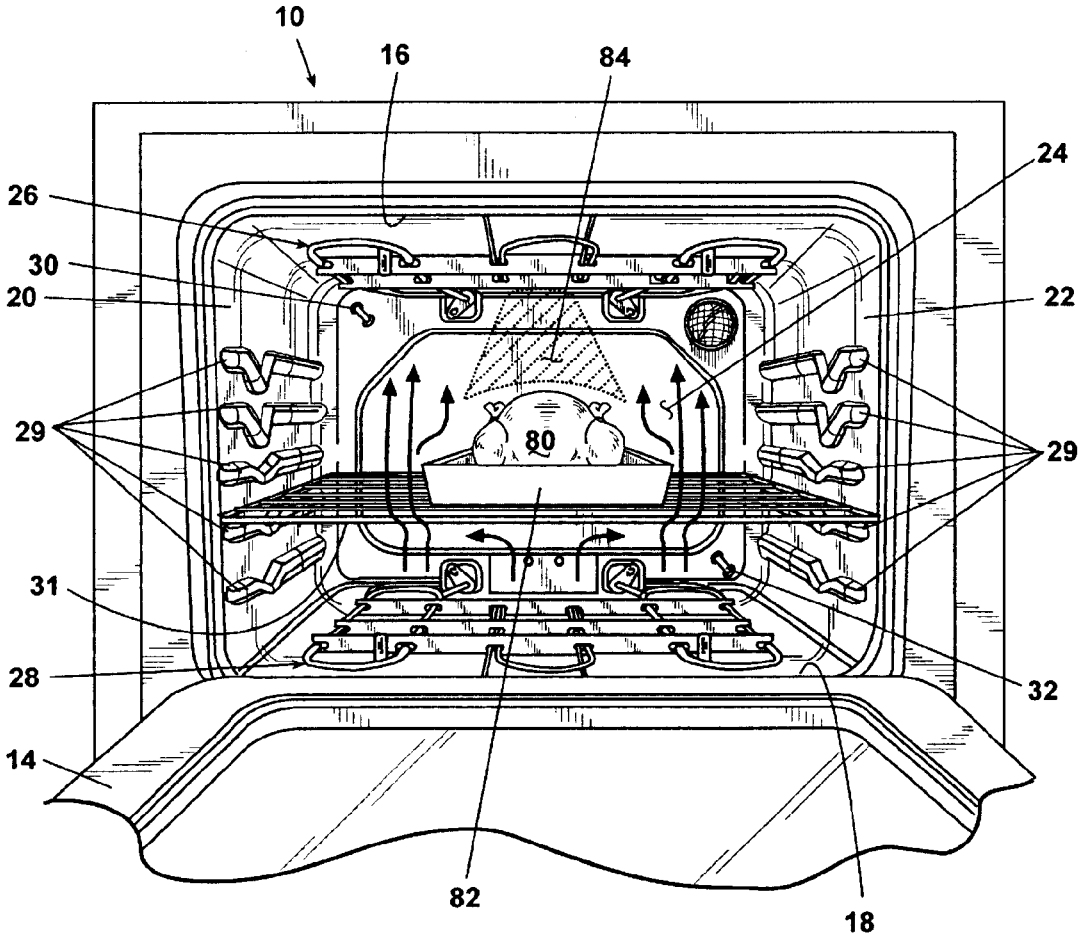
FIG. 1A is a perspective view of the baking cavity of FIG. 1, wherein a food product in a baking pan is placed on the rack in the baking cavity, and arrows show the general heat track around the baking pan and food product when the bake heating element is activated, whereby a dead heating zone is defined above the food product.

FIG. 1 illustrates an oven 10 incorporating a selective control of the top heat according to the invention. The oven 10 is primarily described in the context of reducing the top heat to improve overall browning performance, although the invention applies equally as well to increasing the top heat.

The oven 10 comprises an open-face housing defining a baking cavity 12, with the open face enclosed by a hinged door 14. The open face housing is formed by opposing top and bottom walls 16, 18, opposing side walls 20, 22, and a rear wall 24. A broil heating element 26 is mounted adjacent the upper wall of the baking cavity 12 and a bake heating element 28 is mounted adjacent the lower wall of the baking cavity. The side walls 20, 22 are provided with rack supports 29 extending generally in horizontal fashion depth-wise into the baking cavity 12 along the side walls 20, 22 for supporting a baking rack 31 thereon.

Figure 2:
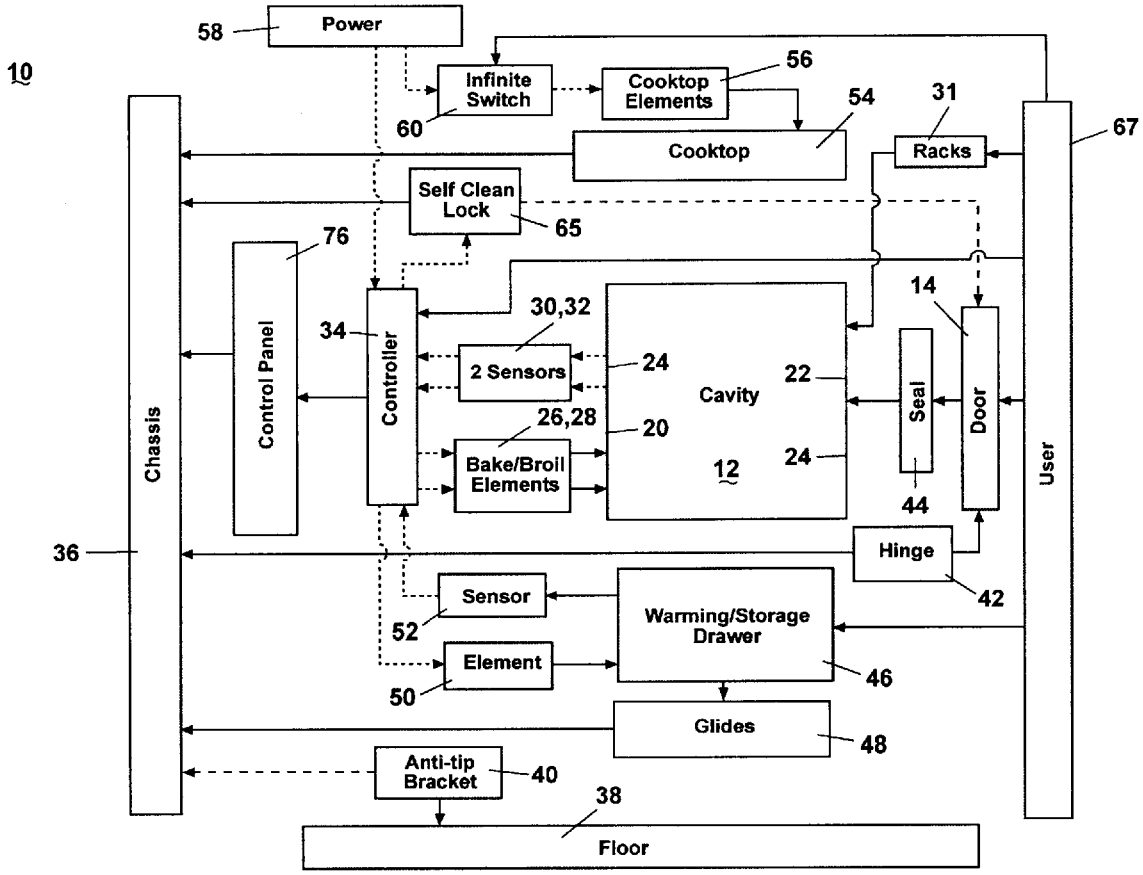
FIG. 2 is a block diagram showing the general components of the oven of FIG. 1 configured for electric-based heating elements.
Figure 3:
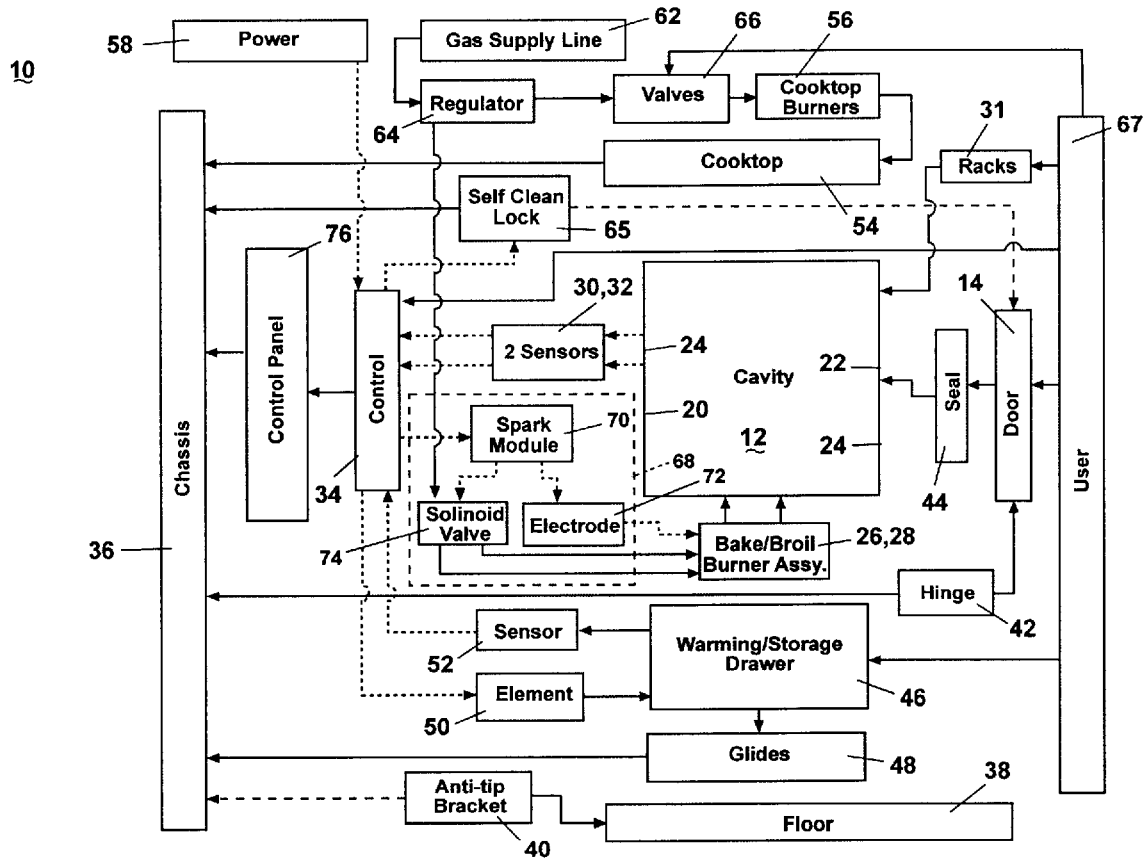
FIG. 3 is a block diagram showing the general components of the oven of FIG. 1 configured for gas-based heating elements.

In FIGS. 1–2, the oven 10 is shown configured for electric-based heating elements and in FIG. 3 for gas-based heating elements. In both configurations a broil temperature sensor 30 is located adjacent to a broil heating element 26 and a bake temperature sensor 32 is located adjacent a bake heating element 28. The broil temperature sensor 30 and the bake temperature sensor 32 are interconnected to a controller 34.

FIGS. 2–3 show block diagrams of electric- and gas-based ovens, 10, respectively, since the particular mechanical interconnection and assembly of the elements of the block diagrams shown in FIGS. 2–3 are not critical to the invention and any of the well-known components making up prior art ovens will suffice, as this invention relates to the method of controlling the top heat or the radiated heat from the broil heating element to improve the browning performance of the oven.

With reference to FIGS. 1–3, the general components making up the oven 10 according to the invention include an oven chassis 36 that supports the components making up the oven 10 on a floor 38. An anti-tip bracket 40, mechanically couples the chassis 36 to either the floor or the wall to prevent the oven from tipping when a large weight is placed on the door 14. The door 14 is typically mounted to the chassis 36 by a hinge 42 and maintains the integrity of the baking cavity 12 by a seal 44 that is preferably effective in preventing heat from escaping the cavity 12.

A warming/storage drawer 46 is typically provided at a lower portion of the chassis 36 and mounted thereto by conventional glides 48 permitting slidable movement of the warming/storage drawer 46 relative to the chassis 36. The warming/storage drawer 46 is typically provided with its own heating element 50 interconnected to the controller 34 and actuated by the controller 34 via a signal from a temperature sensor 52 located within the warming/storage drawer 46.

The oven 10 can also include a conventional cooktop 54 typically comprising several cooktop burners or elements 56. In the electric-based oven 10 shown in FIG. 3, the cooktop burners/elements 56 are interconnected to an electric power supply 58 via a switch 60 as is conventionally known. In the gas-based oven 10 shown in FIG. 4, the cooktop burners/elements 56 are interconnected to a gas supply line 62 via a regulator 64 and several valves 66 also as is conventionally known. In both the embodiments of FIGS. 3–4, the power supply 58 is also interconnected to the controller 34 to supply power thereto.

A latch 65 is also mounted on the chassis 36 and is preferably interconnected to the controller 34 and the door 14. A user 67 manually actuates the latch 65 to latch the door to the chassis 36 to lockably enclose the cavity 12. Further, the controller 34 can send a signal to the latch 65 to automatically lock the door 14 to the chassis 36 enclosing the cavity during oven cleaning operations, thus preventing the user 67 from opening the door 14.

In the electric-based oven 10 shown in FIG. 2, the broil heating element 26 and the bake heating element 28 are directly interconnected to the controller 34, which controls the supply of power from the power supply 58 to selectively heat the cavity 12 in a controlled fashion. In the gas-based version shown in FIG. 3, the broil heating element 26 and the bake heating element 28 are interconnected to the controller 34 via a gas control assembly 68 that comprises a spark module 70 (i.e., an igniter) for passing a spark to an electrode 72 which, in turn, interacts with a volume of gas released by a solenoid valve 74 that is interconnected to the gas supply line 62 via the regulator 64.

The controller 34 is interconnected to a control panel 76 mounted to the chassis 36 that contains among other things, actuator devices such as control knobs that allow the user 67 to set, among other things, the particular heating mode of the oven 10 (e.g., BAKE, BROIL, CLEAN, etc.) and, to the extent the user has selected either the bake or broil heating modes, a target temperature set point at which the user desires to cook food products in the baking cavity 12.

Figure 4:
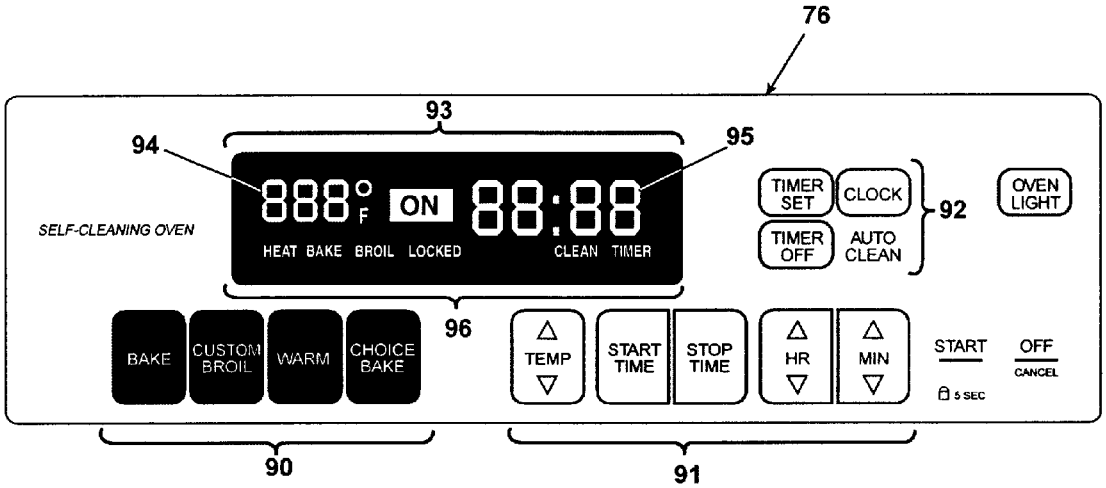
FIG. 4 illustrates a sample control panel for use with either the gas or electric ovens shown in FIGS. 3 and 4 and incorporates a CHOICE BAKE selector in the form of a button for selecting the reduced top heat cooking cycle according to the invention.

The control panel 76 is shown in greater detail in FIG. 4. The control panel 76 comprises a variety of keypads for selecting or inputting cooking cycle related data. For example, a cycle keypad 90 is provided and comprises buttons labeled BAKE, CUSTOM BROIL, WARM, and CHOICE BAKE, which correspond to a particular cooking cycle. The depression of the button will initiate the corresponding cycle. For example, if a traditional bake cycle is desired, the user will depressed the BAKE button.

A data input keypad 91 is provided and includes buttons labeled TEMP, START TIME, STOP TIME, HR, and MIN. The START TIME and STOP TIME are used to program the start and stop times of a time bake cycle. The TEMP, HR, MIN buttons are toggle buttons which can provide for the entry of the cooking temperature, and cooking time in hours and minutes. Pressing the top of each of the toggle buttons increases the value while pressing the lower portion of the toggle buttons decreases the value.

A timer keypad 92 is provided for programming the timer function of the oven. The timer keypad comprises a TIMER SET button for initiating the timer function and a TIMER OFF button for turning off the timer function. A CLOCK button is provided for setting the time of day for the timer for use in a time bake cycle. Also, an AUTO CLEAN button is provided for selecting the self cleaning mode for the oven.

A display 93 is provided and includes a temperature display 94, a timer 95, and a series of indicators 96. As illustrated, the indicators are lighted text messages and include: HEAT, BAKE, BROIL, LOCKED, CLEAN, TIMER, ON. The HEAT indicator is illuminated when the heating element is activated. The BAKE and BROIL indicators are illuminated when the corresponding button in the cycle keypad is selected. The CLEAN indicator is illuminated when the oven is in the self-cleaning cycle. The TIMER indicator is illuminated when the timer function is initiated. The ON indicator is illuminated when the oven is turned on.

Other miscellaneous buttons include the START, OFF, and OVEN LIGHT buttons. The START button is depressed after the selection of any cycle to start the cycle. The OFF button is selected when it is desired to manually terminate any selected cycle. The OVEN LIGHT button is selected to turn on the light inside the cooking cavity.

Figure 4A:
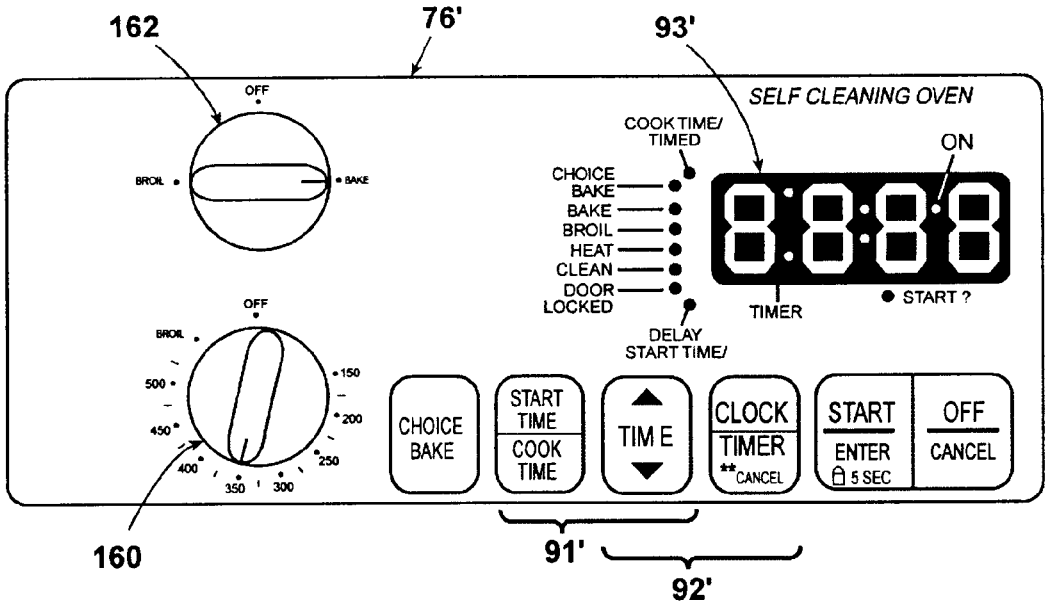
FIG. 4A illustrates a first alternative control panel having control knobs for selecting the bake mode and the temperature and a CHOICE BAKE button for selecting the reduced top heat.
Figure 4B:
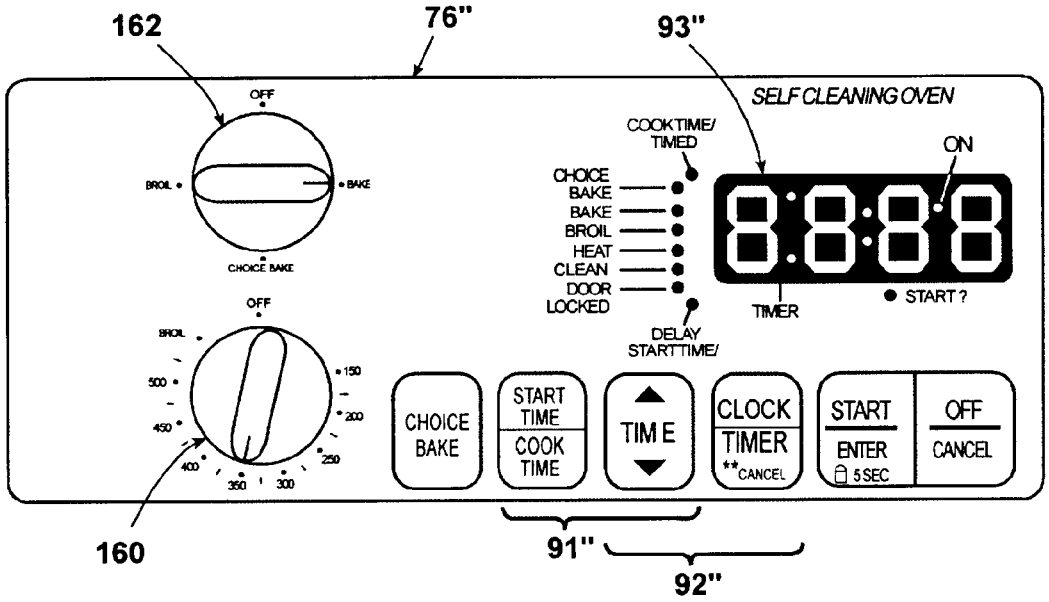
FIG. 4B illustrates a second alternative control panel similar to the first alternative, except that the CHOICE BAKE selector is incorporated with the bake mode knob.

FIG. 4A illustrates a first alternative control panel 76' comprising substantially the same data input keypad 91' and timer keypad 92', which share a TIME input button. The control panel further comprises a display 93' incorporating multiple status and mode indicators comprising text (COOK TIME/TIMED, CHOICE BAKE, BAKE, BROIL, HEAT, CLEAN, DOOR LOCKED, and DELAY START TIME) with a corresponding light. The display 93' includes a time display 95', but does not include a temperature display as does the control panel 76. Instead, a temperature dial or control knob 160 is used. The knob 160 is rotated to the desired baking temperature to set the baking temperature.

The control panel 76' also does not include a cycle keypad 90. Instead, the control panel 76' includes a cycle dial or control knob 162. The knob includes OFF, BAKE, and BROIL positions. By turning the knob to one of these positions, the user can select that cycle. A separate CHOICE BAKE button is provided on the control panel 76'. The selection of the CHOICE BAKE button operates in the same manner as that described for the display 76.

The control panel 76' also comprises miscellaneous buttons, such as START and OFF.

The operation of the invention is described with respect to FIGS. 5–10 and with reference to the control panel 76. The operation also applies to the other control panels 76' and 76", the only difference being in how the cycle, temperature, and CHOICE BAKE option are selected. It should also be noted that while push button switches and control knobs are shown in the displays, these terms are also meant to include and reference any type of suitable selector.

The operation of the invention is described with respect to FIGS. 5–10 and with reference to the control panel 76. The operation also applies to the other control panels 76' and 76", the only difference being in how the cycle, temperature, and CHOICE bake option are selected. It should also be noted that while push button switches and control knobs are shown in the displays, these terms are also meant to include and reference any type of suitable selector.

FIGS. 5–10 illustrate a preferred protocol for implementing a bake cycle for the dual element oven as disclosed. It should be noted that the invention is not limited to the preferred protocol as described. The CHOICE BAKE cycle and corresponding structure can be used with any type of protocol for implementing a bake cycle. It should also be noted that while the CHOICE BAKE cycle is illustrated as an option or alteration to the selected bake cycle, the CHOICE BAKE cycle can be a completely independent cycle.

For the purposes of the flowcharts describing the inventive method herein of FIGS. 4–10, it is assumed that the user 67 has accessed the control panel 76 and set the heating mode of the oven to BAKE, preferably by selecting the BAKE button from the cycle keypad 80, and set a target temperature set point (i.e., the desired temperature to which the baking cavity 12 is to be heated and closely controlled and maintained at that temperature during the BAKE cycle) by using the TEMP button from the data input keypad 82.

If either control panel 76' or 76" is used, the target temperature set point TARGET_TEMP is set by the user 67 typically selecting from various temperatures in 5–50 degree increments in degrees F such as 150, 200, 250, 300, 350, 400, 450, 500, with intervening 25 degree markings, for example.

Figure 5:
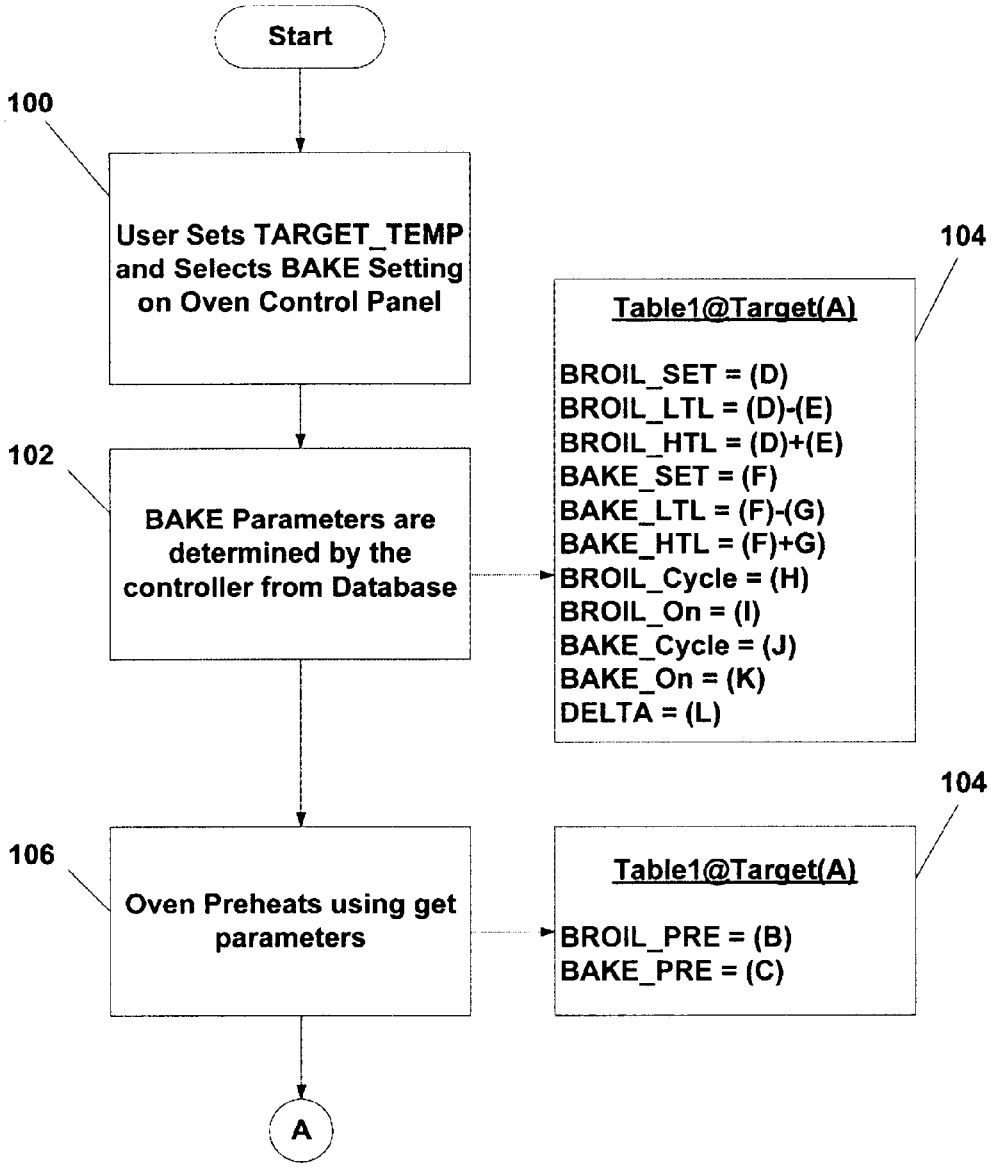
FIG. 5 is a flowchart for controlling the temperature of the baking cavity of the ovens shown in FIGS. 1–3, specifically showing the steps of gathering information from a user, determining specific parameters for the bake mode and preheating the baking cavity of the oven using those set parameters in proceeding to the flowchart shown in FIG. 6.

The method of controlling the temperature of the baking cavity 12 at the user-selected target temperature set point TARGET_TEMP in the BAKE mode is shown at 100 in FIG. 5. Once these parameters are set by the user at step 100, processing moves to step 102, wherein further bake mode parameters are determined by the controller 34 from a database 104. The database 104 can be any simple look-up table or a relational database that supplies data to the controller 34 based upon the make and/or model of oven 10 employed. An example of the database 104 appears in the following Table 1.

typical temperature settings used in baking and provided on the control panel 76 for setting the desired target temperature set point TARGET_TEMP. Table 1 shows several rows corresponding to these typical values in degrees F including 200, 250, 300, 325, 330, 350, 400, 440, 450 and 475. It should be known that this invention is not limited by the values shown in Table 1 as these should be interpreted as merely an example of the data used by the controller 34 and should not be limiting on the invention.

Table 1 also includes a first column which groups the rows of Table 1 into low-, mid-, and high-temperature bands wherein the low-temperature band ranges from 200–325° F., the mid-temperature band ranges from 330–440° F. and the high-temperature band ranges from 450° F. and higher. These groupings were made by trial selection. It has been found that particular heating ranges such as the low-, mid- and high-temperature bands shown in Table 1 each exhibit common characteristics which allow certain equations to be attributed individually to the two target temperatures falling within these target temperature bands as will be further described below.

Columns B and C of the database 104 shown by example in Table 1 include target set temperature points for the broil heating element 26 and the bake heating element 28, respectively. These values represent the desired targets to have the broil temperature sensor 30 and the bake temperature sensor 32 read during preheating of the oven 10. It will be noted that the preheat broil target temperature of column B and the preheat bake target temperature of column C exceed the target temperature of column A by 30, 30 and 20 for the low-, mid- and high-temperature bands, respectively.

It should not be limiting to this invention that the preheat broil and preheat bake target temperatures are shown as equal values as it is equally contemplated that these values could differ under a different oven preheating cycle. Further, the "overshoot" differences, i.e., the amount the preheat broil and preheat bake target temperatures of columns B and C of the database 104 of Table 1 exceed the target temperature set point of Column A, can also be selected as different values without departing from the scope of this invention, as those values shown are by example and not by limitation.

TABLE 1

Bake Method Temperature and Time Set Points
(all Temperatures in degrees F. and times in seconds)

| | A | B | C | D | E | F | G | H | I | J | K | L |
|---|---|---|---|---|---|---|---|---|---|---|---|---|
| | | | | Broil | | Bake | | Broil | | Bake | | |
| Temp | | Preheat | | Set | Ampl | Set | Ampli | Cycle | On | Cycle | On | |
| Band | Target | Broil | Bake | Point | itude | Point | tude | Time | Time | Time | Time | Delta |
| LOW | 200 | 230 | 230 | 188 | 1 | 182 | 1 | 60 | 15 | 60 | 60 | 6 |
| | 250 | 280 | 280 | 238 | 1 | 232 | 1 | 60 | 15 | 60 | 60 | 6 |
| | 300 | 330 | 330 | 288 | 1 | 282 | 1 | 60 | 15 | 60 | 60 | 6 |
| | 325 | 355 | 355 | 313 | 1 | 307 | 1 | 60 | 15 | 60 | 60 | 6 |
| MID | 330 | 360 | 360 | 314 | 1 | 302 | 1 | 60 | 35 | 60 | 60 | 12 |
| | 350 | 380 | 380 | 334 | 1 | 322 | 1 | 60 | 35 | 60 | 60 | 12 |
| | 400 | 430 | 430 | 384 | 1 | 372 | 1 | 60 | 35 | 60 | 60 | 12 |
| | 440 | 470 | 470 | 424 | 1 | 412 | 1 | 60 | 35 | 60 | 60 | 12 |
| HIGH | 450 | 470 | 470 | 434 | 1 | 420 | 1 | 60 | 40 | 60 | 60 | 14 |
| | 475 | 495 | 495 | 459 | 1 | 445 | 1 | 60 | 40 | 60 | 60 | 14 |

The example database 104 shown in Table 1 has twelve columns labeled consecutively by letters A–L. Column A in Table 1 corresponds to the target temperature set point TARGET_TEMP set by the user 67 on the control panel 76. Table 1 contains several rows each corresponding to the Columns D-E and F-G of the database 104 shown by example in Table 1 contain a target set point and range amplitude for the broil heating element 26 and the bake heating element 28, as to be detected by the broil temperature sensor 30 and the bake temperature sensor 32, respectively, during the BAKE mode as selected by the user 67 for a particular target temperature set point TARGET_TEMP. These values permit the controller 34 to calculate low-temperature limit and high-temperature limit set points for the broil heating element 26 and the bake heating element 28.

For example, at a particular target temperature set point TARGET_TEMP selected by the user 67, the database 104 looks up a corresponding value in Column A and sets a variable BROIL_SET to the value in Column D (e.g., 334° F. at a desired target temperature TARGET_TEMP of 350° F.). The controller 34 then calculates a broil heating element low-temperature limit BROIL_LTL by subtracting the amplitude in Column E from the set point temperature in Column D and calculates a broil heating element high-temperature limit BROIL_HTL by adding the amplitude in Column E to the broil set point temperature in Column D.

For example, at a particular target temperature set point TARGET_TEMP selected by the user 67, the database 104 looks up a corresponding value in Column A and sets a variable BAKE_SET to the value in Column F (e.g., 322° F. at a desired target temperature set point TARGET_TEMP of 350° F.). The controller 34 then calculates a bake heating element low-temperature limit BAKE_LTL by subtracting the amplitude in Column G from the set point temperature in Column F and calculates a bake heating element high-temperature limit BAKE_HTL by adding the amplitude in Column G to the bake set point temperature in Column F.

Columns H and I define the duty cycle for the broil heating element 26, i.e., the length of time comprising the normal heating cycle of the broil heating element 26 and the length of time (in seconds) that the broil heating element 26 is on during that time. Column H represents the length of time BROIL_CYCLE that the broil heating element 26 stays on upon a signal to activate the broil heating element 26 from the controller 34. Column I represents the amount of time in seconds BROIL_ON that the broil heating element is actually emitting heat during the BROIL_CYCLE. For example, at a desired target temperature of 350°, the broil heating element 26 has a total cycle time of 60 seconds (Column H at a target temperature set point of 350° from Column A) and the broil heating element stays on approximately 35 seconds out of that 60-second time (Column I at a desired target temperature set point of 350° in Column A).

For the LOW temperature range, the BROIL_ON time is 15 seconds out of a 60 second BROIL_CYCLE. For the MID and HIGH temperature ranges, the BROIL_ON time is 35 seconds and 40 seconds, respectively, for the same BROIL_CYCLE value. Thus, as the temperature range increases, the broil heating element is kept on a greater amount, which will increase the top heat that is radiated directly onto the food item.

Columns J and K define the duty cycle for the bake heating element 28, i.e., the length of time comprising the normal heating cycle of the bake heating element 28 and the length of time (in seconds) that the bake heating element 28 is on during that time. Column J represents the length of time BAKE_CYCLE that the bake heating element 28 stays on upon a signal to activate the bake heating element 28 from the controller 34. Column K represents the amount of time in seconds BAKE_ON that the bake heating element 28 is actually emitting heat during the BAKE_CYCLE. For example, at a desired target temperature of 350° the bake heating element 28 has a total cycle time of 60 seconds (Column J at a target temperature set point of 350° from Column A) and the bake heating element 28 stays on approximately 35 seconds out of that 60-second time (Column K at a desired target temperature set point of 350° in Column A).

Column L is an optional column in the database which is essentially used as a tool to conserve memory in the controller 34 by creating a value DELTA in Column L which defines the relationship between the bake set point in Column F and the broil set point in Column D., i.e., DELTA in Column L represents the number of degrees F by which the broil set point of Column D exceeds the bake set point in Column F. Thus, if the DELTA value in Column L is employed, one of the broil set points in Column D and the bake set point BAKE_SET in Column F is unnecessary as the other of these two values could be calculated by adding or subtracting the DELTA value in Column L to either Column D or Column F.

Thus, memory can be conserved by employing the fewer bits to represent the DELTA value in Column L rather than the larger number of either Column D or Column F (BROIL_SET or BAKE_SET) which requires more bits to store this value. While this memory saving may not be a concern with controllers 34 with large amounts of RAM or ROM, this memory-saving technique can be significant for controllers 34 with smaller amounts of memory.

In summary, when the user sets the desired target temperature set point TARGET_TEMP and selects the bake mode on the control panel 76 at step 100, the processing moves to step 102 where the controller 34 looks up and calculates the following bake parameters from the database 104 shown by example in Table 1. All values in Table 1 are shown in degrees F and all times are shown in seconds. Also, in the following equations, a capital letter shown in parentheses (e.g., (D)) represents a value from the column identified by the letter in parentheses at the intersection of the row corresponding to the desired target temperature set point TARGET_TEMP set by the user 67 on the control panel 76.

BROIL_SET=(D) (or) (F)+(L);
BROIL_LTL=BROIL_SET (E);
BROIL_HTL=BROIL_SET+(E);
BAKE_SET=(F) (or) BROIL_SET (L);
BAKE_LTL=BAKE_SET (G);
BAKE_HTL=BAKE SET+(G);
BROIL_CYCLE=(H);
BROIL_ON=(I);
BAKE_CYCLE=(J);
BAKE_ON=(K); and
DELTA (if used)=(L).

The database 104 can also be used to look up the preheating target set point temperatures BROIL_PRE=(B) and BAKE_PRE=(C).

It is important to note that the parameters and the corresponding values shown in Table 1 are illustrative and not limiting to the invention. The particular values for each of the parameters can vary depending on the particular oven characteristics, such as, for example: baking cavity volume, broiler heating output, oven heating output, and desired response time in the case of the initial temperature overshoot. The particular values for a given oven can be determined by standard testing procedures.

Once these values are established, processing moves to step 106 in which the oven is preheated using the parameters looked up in the database 104 in step 102. The preheat routine is relatively simple and relates to selectively actuating the broil heat element 26 until the broil temperature sensor 30 reads an excess of BROIL_PRE and selectively actuating the bake heating element 28 until the bake temperature sensor 32 reads an excess of BAKE_PRE. It is preferred that the broil heating element 26 and the bake heating element 28 be actuated independently of each other so that at no time the broil heating element 26 is on the same time as the bake heating element 28, since the actuation of both heating elements 16 and 18 at once can cause the rate of ambient temperature rise in the baking cavity 12 to increase dramatically, often beyond the ability of the controller 34 to compensate for this increase. It will also be understood that the broil heating element 26 and the bake heating element 28 are preferably actuated according to their duty cycles defined in columns H-I and J-K by the BROIL_CYCLE, BROIL_ON, BAKE_CYCLE and BAKE_ON parameters determined in step 102 by a look up to the database 104.

Figure 6:
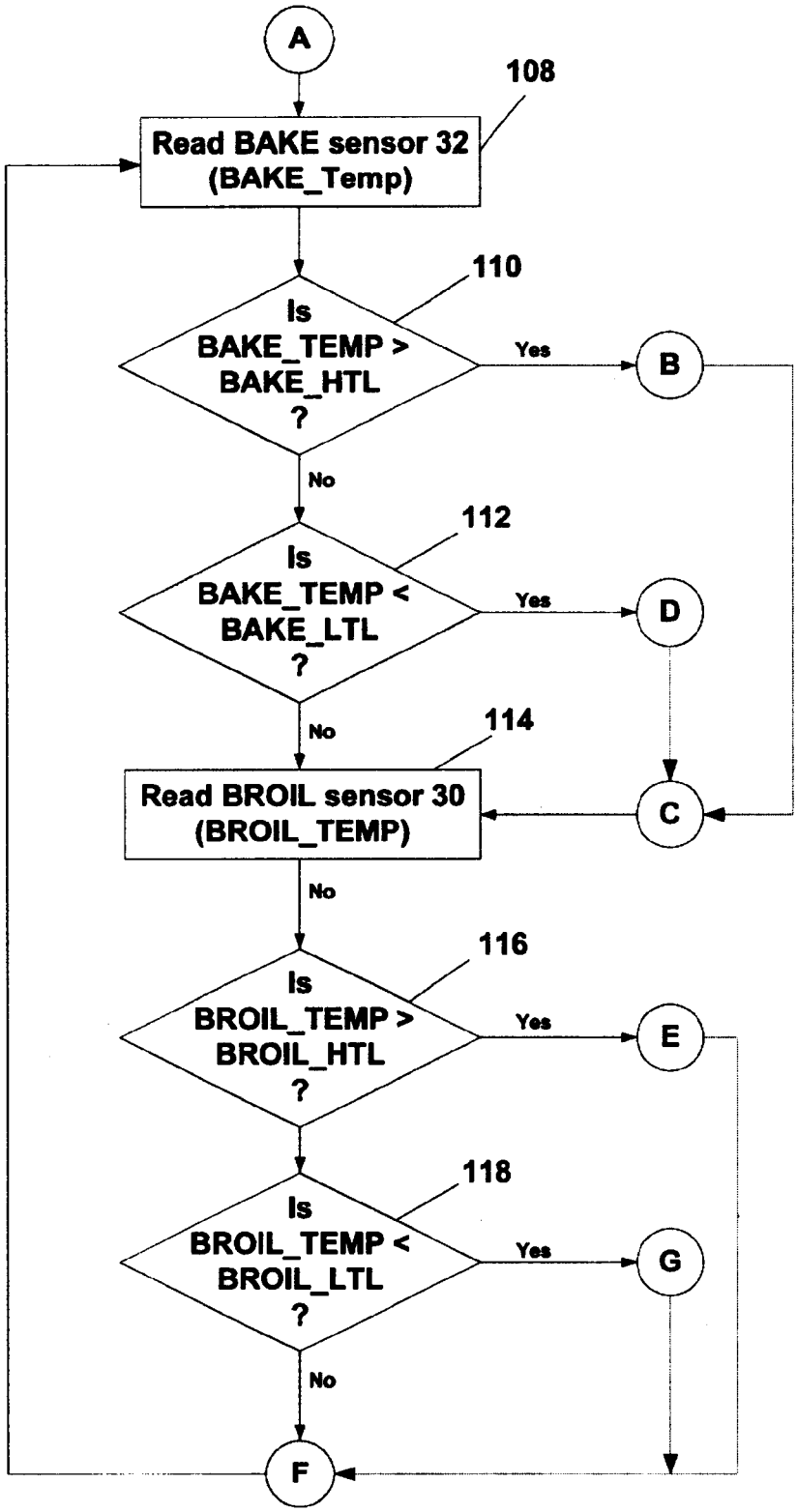
FIG. 6 is a flowchart continuing from point "A" of FIG. 5 and shows a main set of steps for checking the temperature sensors shown in FIG. 2 adjacent each of the bake and broil heating elements and calling subprocess in FIGS. 7, 8, 9 and 10 as indicated by subprocess calls "B," "D," "E," and "G," respectively.

Once the oven has preheated, typically by overshooting the desired target temperature TARGET_TEMP, processing moves to a connecting flowchart in FIG. 6 via connector "A." An overview of the control process will be useful in understanding the detailed operation. After the setting of the control parameters (FIG. 5), the broil and bake heating elements 26 and 28 are activated to maintain the temperature of the cavity adjacent the corresponding broil and bake temperature sensors 30 and 32 between the high and low temperature limit set points, respectively (FIG. 6).

Figure 7:
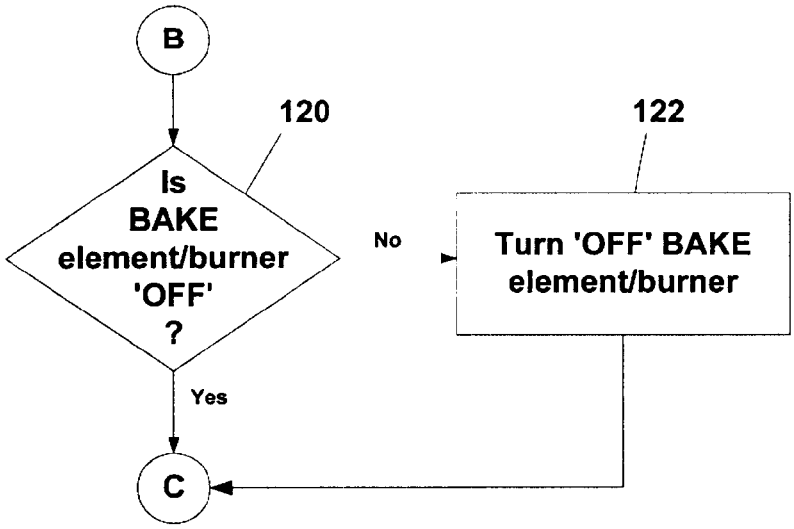
FIG. 7 is a flowchart showing the method steps performed if subprocess "B" is called from FIG. 6.

It is preferred that neither the bake nor the broil heating element is activated simultaneously (FIGS. 7–10) and priority is given to the bake heating element (FIG. 7). In other words, if both the bake and broil heating elements require activation, the bake heating element is activated even if the broil heating element must be turned off.

The benefits of alternate actuation of the bake and broil heating elements (28 and 26) can be seen from an examination of FIGS. 2A and 2B. FIG. 2A is a perspective view of the baking cavity 12 of FIG. 2 wherein a food product 80 in a baking pan 82 is placed on the rack 31 in the baking cavity 12. As can be seen from FIG. 2A, arrows show the general heat track around the baking pan 82 and food product 80 when the bake heating element 28 is activated. Since the heat from the bake heating element 28 generally tracks around the baking pan 82 and food product 80 and then generally rises vertically, a dead heating zone 84 is defined above the food product 80 where the heat from the bake heating element 28 does not effectively cook the food product 80. In the case of a low temperature item such as frozen poultry, this dead heating zone 84 can cause significant detriment to the cooking of the food product 82.

Figure 1B:
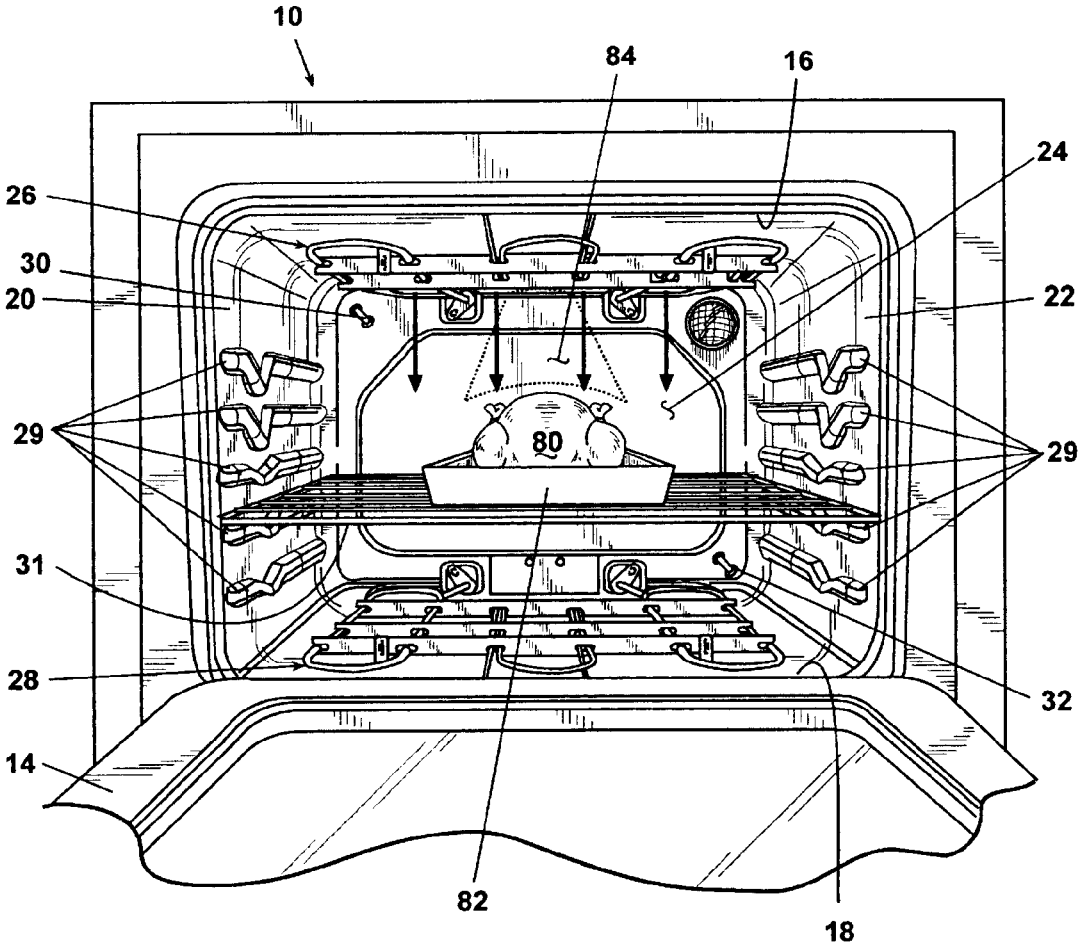
FIG. 1B is a perspective view of the baking cavity of FIG. 1, wherein a food product in a baking pan is placed on the rack in the baking cavity, and arrows show the general heat track around the baking pan and food product when the broil heating element is activated, thus reducing the negative baking effects of the dead heating zone above the food product shown in FIG. 1A.

This invention addresses this problem by periodically activating the broil heating element 26 based upon signals from the broil temperature sensor 30 in addition to the periodic activation of the bake heating element 28 based upon signals from the bake temperature sensor 32. This causes heat to be applied to the food product 80 from above as well as shown in FIG. 1B. The arrows in FIG. 1B show the general heat toward the food product 80 from the broil heating element 26 directly through the dead heating zone 84 thus reducing the negative baking effects of the dead heating zone 84 above the food product 80.

FIG. 6 represents the main control routine for controlling the temperature in the baking cavity 12 of the oven 10. Processing then moves to step 108 in which the controller accepts a signal BAKE_TEMP from the bake temperature sensor 32, which is indicative of the temperature in the cavity 12 at the sensor 32 location. Processing moves to decision point 110 where it is determined whether BAKE_TEMP exceeds the desired high temperature limit for the bake heating element BAKE_HTL. If so, processing passes to the subprocess shown in FIG. 7 via connector "B" in FIG. 6. If not, processing moves to decision point 112.

Figure 8:
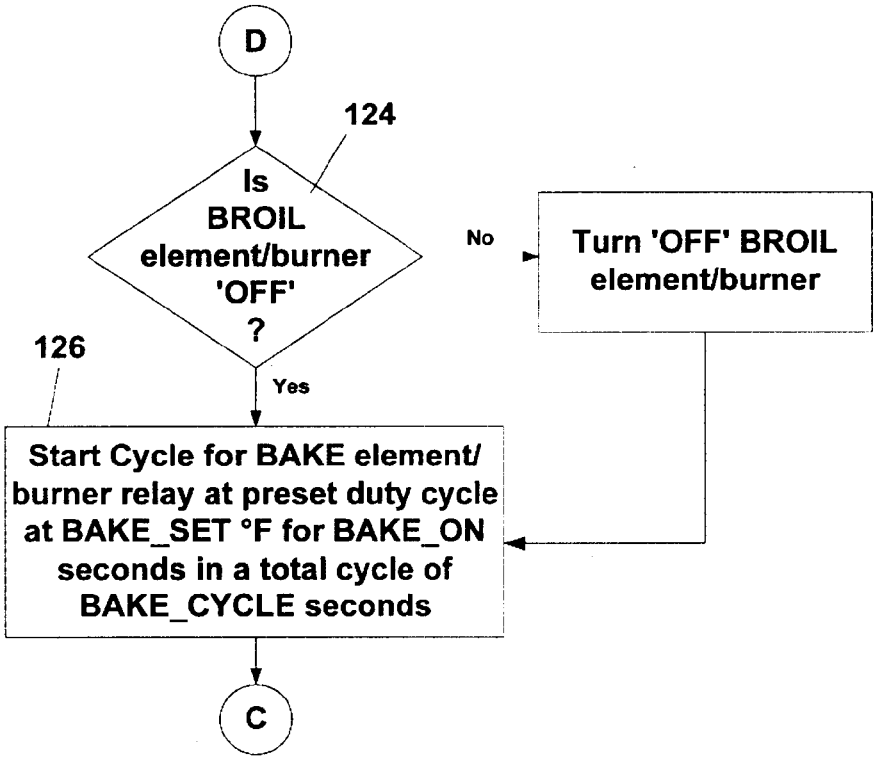
FIG. 8 is a flowchart showing the method steps performed if subprocess "D" is called from FIG. 6.

At decision point 112, it is determined whether the value of the signal BAKE_TEMP emitted by the bake temperature sensor 32 is less than the desired lower temperature limit for the bake heating element 28 BAKE_LTL. If so, the subprocess shown in FIG. 8 is called via the connector "D" shown in FIG. 6. If not, processing moves to step 114.

At step 114, the controller 34 receives a signal from the broil temperature sensor 30 corresponding to the temperature BROIL_TEMP read by the broil temperature sensor 30. It should also be noted that processing returns from the subprocess noted by "B" and the subprocess identified by "D" to the method step shown in FIG. 6 by the connector shown as "C" which returns the processing of these subprocesses to step 114 as well.

Figure 9:
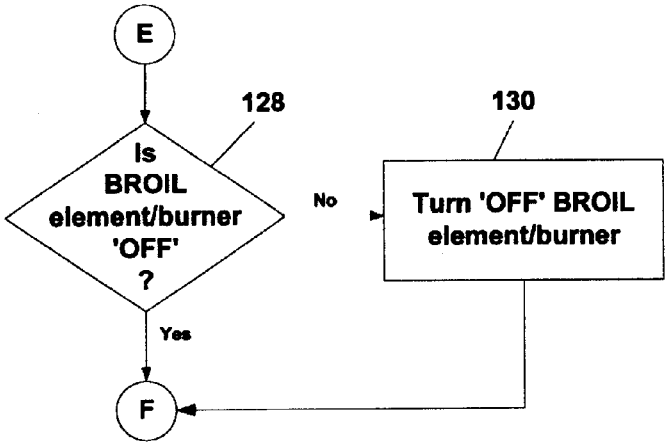
FIG. 9 is a flowchart showing the method steps performed if subprocess "E" is called from FIG. 6.

Processing then moves to decision point 116. At decision point 116, the controller 34 determines whether the value BROIL_TEMP read in step 114 exceeds the desired high temperature limit for the broil heating element 26 BROIL_HTL. If so, the subprocess shown in FIG. 9 is called as indicated by connector "E" in FIG. 6. If not, processing passes to decision point 118.

Figure 10:
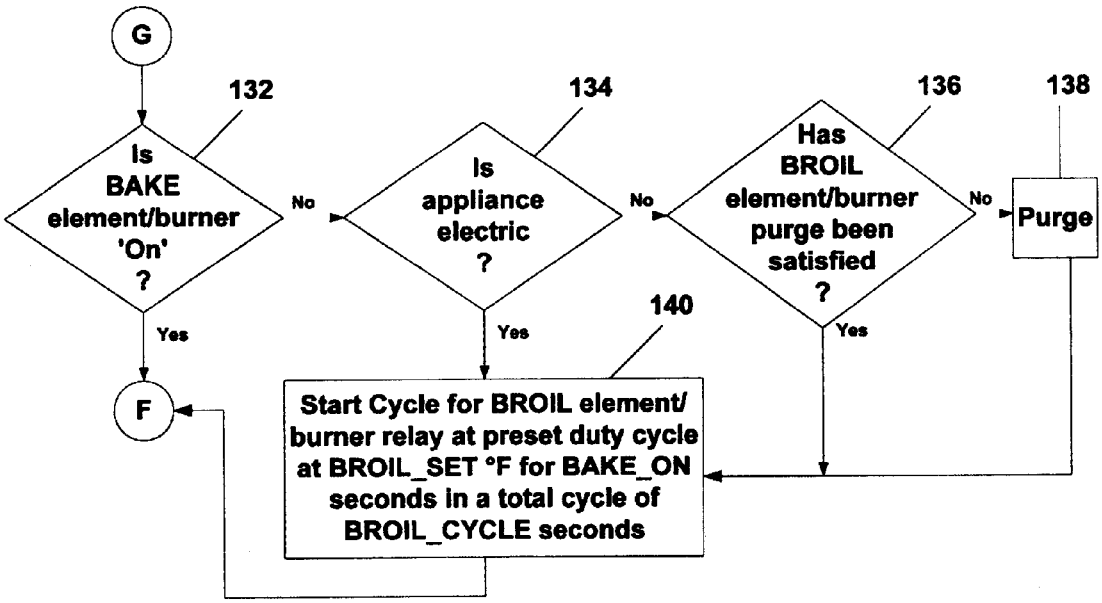
FIG. 10 is a flowchart showing the method steps performed if subprocess "G" is called from FIG. 6.

At decision point 118, the controller 34 determines whether the value read by the broil temperature sensor 30 BROIL_TEMP is less than the desired lower temperature limit for the broil heating element 26 BROIL_LTL. If so, the subprocess of FIG. 10 is called as indicated by connector "G" on FIG. 6. If not, processing passes to the intermediate point indicated by connector "F" in FIG. 6, at which time processing loops back to step 108.

It should also be noted that the subprocess of FIG. 9, as indicated by connector "E" on FIG. 6, and the subprocess of FIG. 10, indicated by connector "G," each return their processing to the connector indicated as "F" on FIG. 6 and, thereby, also loop back to step 108 for continued processing of the main loop shown in FIG. 6.

FIG. 7 represents the subprocess called by decision point 110 if the temperature signal BAKE_TEMP read in step 108 exceeds the desired high temperature limit for the bake heating element 28 BAKE_HTL. Processing then moves to decision point 120 at which point the controller 34 determines whether the bake heating element 28 is OFF. If the bake heating element is OFF, the subprocess merely loops back via the connector shown as "C" whereby processing is returned to step 114 of FIG. 6.

If the bake heating element 28 is ON, processing moves to step 122 where the controller deactivates the bake heating element 28. Processing then returns to step 114 of FIG. 6 via the connector shown at "C". The net effect of this subprocess is to turn off the bake heating element 28 if the bake temperature sensor 32 reads a temperature BAKE_TEMP in excess of the high temperature limit BAKE_HTL as determined in the database 104.

FIG. 8 represents the method steps performed when decision point 112 determines that the temperature signal emitted by the bake temperature sensor 32 BAKE_TEMP is less than the desired lower temperature limit for the bake heating element 28 BAKE_LTL. Processing then moves to decision point 124 where the controller 34 determines whether the broil heating element 26 is currently deactivated, i.e., in all OFF state. If so, processing moves to step 126 where the bake heating element is activated for its predefined duty cycle as determined by the controller 34 in the database 104.

Specifically, the duty cycle activates the bake heating element 28 for a cycle of BAKE_CYCLE seconds of which the bake heating element 28 is on for BAKE_ON seconds of that total cycle time at a temperature of BAKE_SET degrees F. It should be noted that the duty cycle of the bake heating element 28 is started at step 126 and is continuing as processing is returned via the connector "C" to step 114 in FIG. 6.

The net effect of the subprocess steps of FIG. 8 is, once a determination is made that the bake temperature sensor 32 is reading a temperature BAKE_TEMP less than the desired lower temperature limit for the bake heating element 28 BAKE_LTL, the duty cycle for the bake heating element 28 is initiated but only after deactivating the broil heating element 26 to ensure that the broil and bake heating element 26 and 28 are not actuated at the same time which can cause sudden uncontrolled temperature increases in the baking cavity 12.

FIG. 9 represents the subprocess called by decision point 116 if the temperature signal BROIL_TEMP read in step 116 exceeds the desired high temperature limit for the broil heating element 26 BROIL_HTL. Processing then moves to decision point 128 at which point the controller 34 determines whether the broil heating element 26 is OFF. If the broil heating element 26 is OFF, the subprocess merely loops back via the connector shown as "F" whereby processing is returned via connector "F" to FIG. 6. If the broil heating element 26 is ON, processing moves to step 130 where the controller 34 deactivates the broil heating element 26. Processing then returns to FIG. 6 via the connector shown at "F". The net effect of this subprocess is to turn off the broil heating element 26 if the broil temperature sensor 32 reads a temperature BROIL_TEMP in excess of the high temperature limit BROIL_HTL as determined in the database 104.

FIG. 10 represents the subprocess called a decision point 118 when the controller 34 determines that the temperature signal BROIL_TEMP sent by the broil temperature sensor 30 is less than the desired lower temperature limit for the broil heating element 26 BROIL_LTL. If so, processing moves along connector "G" from FIG. 6 to FIG. 10 to decision point 132.

At decision point 132, the controller 34 determines whether the bake heating element 28 is currently activated, i.e., in an ON state. If so, processing returns to FIG. 6 via connector "F" which thereby returns processing to step 108 in FIG. 6. If the bake heating element 28 is not currently ON, processing moves to decision point 134 where the controller checks whether this is an electric-based oven 10 or a gas-based oven 10. If a gas-based oven 10 is detected (i.e., the test whether the oven is electric fails), processing moves to decision point 136. At decision point 136, the controller 34 determines whether the broil heating element 26 burner purge time has been satisfied (gas-based systems require a certain amount of time to elapse before a heating element may be reactivated).

If the burner purge time has not been satisfied, processing moves to step 138 at which time the gas-based broil heating element 26 is purged in a manner that is well known in the art. After which, processing moves to step 140.

It should also be noted that should the test at decision points 134 and 136 be satisfied in the affirmative, i.e., there is an electric-based oven 10 at issue or the broil heating element 26 purge time has been satisfied, processing also moves directly to step 140. Also, the cycle can be optimized for either an electric or gas oven, instead of the illustrated process that checks for the type of oven. If optimized for one type of oven, the process steps specific to the non-optimized oven can be dropped.

At step 140, the duty cycle for the broil heating element 26 is initiated in the same manner as described with respect to the bake heating element 28 duty cycle described in step 126 of FIG. 8. Specifically, a duty cycle of a total cycle time of BROIL_CYCLE seconds of which the broil heating element 26 is activated and emitting heat for BROIL_ON seconds of that total cycle time.

After the duty cycle for the broil heating element 26 is initiated at step 140, processing returns along the connector "F" to its corresponding connection point "F" at FIG. 6 which thereafter returns processing to step 108 to repeat the steps of FIG. 6.

The net effect of the steps shown in FIG. 10, once it is established that the temperature BROIL_TEMP detected by the broil temperature sensor 30 is less than the desired lower temperature limit BROIL_LTL of the broil heating element 26, is to leave the bake heating element 28 on if it is currently on when the subprocess of FIG. 10 is called. Otherwise, if the bake heating element 28 is off, the duty cycle for the broil heating element 26 is immediately initiated at step 140 for an electric-based oven as determined at decision step 134. For a gas-based oven 10, the controller 34 ensures that the broil heating element 26 purge time has been satisfied and only then initiates the duty cycle for the broil heating element at step 140.

As stated above, once the duty cycle is initiated at step 140, processing returns via connector "F" to FIG. 6 where the cycle of FIG. 6 repeats until the bake time is reached or canceled by the user. The broil and bake heating elements 26 and 28 are activated by the controller 34 as needed with priority given to the bake heating element 28.

The use of dependent sensor for each of the broil and bake heating elements is preferred over a single sensor for controlling both the broil and bake heating elements because the broil and bake temperature sensors 30, 32 are located relatively close to their respective broil and bake heating elements 26, 28, respectively, the temperature sensors 30, 32 are available to allow the broil and bake heating elements 26, 28 to be independently controlled based upon a signal from the corresponding temperature sensor 30, 32. The signal from the sensors is also more indicative of the local temperature of the oven cavity corresponding to the location of the respective heating element. Thus, greater temperature control and accuracy can be achieved within the baking cavity 12 of the oven 10.

The example database 104 shown in Table 1 illustrates that different temperature set points, i.e., BROIL_SET and BAKE_SET are established for the corresponding broil temperature sensor 30 and the bake temperature sensor 32 which can be a function of the location of the particular temperature sensor 30, 32 to its corresponding heating element 26, 28, respectively. It should also be noted, as previously described, that the preheat temperatures BROIL_PRE and BRAKE_PRE are preferably greater than the corresponding desired target temperature TARGET_TEMP set by the user 67 on the control panel 76 at the initiation of the BAKE mode heating cycle of the oven 10. Additionally, the duty cycles of the broil heating element 26 and the bake heating element 28 can be initiated at different duty cycles as defined by the BROIL_CYCLE, BROIL_ON, BAKE_CYCLE, and BAKE_ON as corresponding to the particular target temperature set point TARGET_TEMP for the broil heating element 26 and bake heating element 28 as determined by the target set points for each heating element, i.e., BROIL_SET and BAKE_SET, respectively.

The CHOICE BAKE cycle is an option that can be selected along with the normal BAKE cycle or in lieu of it. That is, the CHOICE BAKE cycle can be implemented, even repeatedly implemented, at any time during a BAKE cycle or can be initially selected. The CHOICE BAKE cycle reduces the amount of top heat radiated from the broil heating element onto the food item to improve the browning performance of the oven. The CHOICE BAKE cycle is implemented by the user selecting the CHOICE BAKE button from the cycle keypad 80. Upon the selection of the CHOICE BAKE button, various parameters of the BAKE cycle are adjusted as shown in Table 2 to reduce the top heat emitted by the broil heating element and thereby reduce the top heat.

TABLE 2

Bake Cycle Parameter Adjustments for Choice Bake Cycle

| | Broil Set Point Adjustment | | |
|---|---|---|---|
| | HIGH Band | MID Band | LOW Band |
| Electric | −5° F. | −5° F. | OFF |
| Gas | −6° F. | OFF | OFF |

The preferred approach to reducing the top heat radiated by the broil heating element on the food item is to reduce the set point for the broil heating element. In other words, the BROIL_SET is reduced from its normal value during the BAKE mode. The reduction of the broil set point results in the broil heating element turning on less than it would otherwise during a normal BAKE mode. Since the broil heating element is on less, there is less top heat directly radiated on the top of the food item, which reduces the amount of browning.

As is shown in Table 2, the amount the set point is reduced takes into consideration both the type of broil heating element (electric or gas) and the temperature band range of the TARGET_TEMP. For an electric broil heating element, the BROIL_SET is reduced 5° F. from the values shown in Table 1 for the TARGET_TEMP for both the HIGH and MID temperature bands. For example, if the TARGET_TEMP is 350° F., the BROIL_SET is 329° F., which is 5° F. less than the 334° F. value shown in Table 1. For the LOW band, the broil heating element is turned off because the bake heating element can supply sufficient heat to maintain the cooking chamber within the desired temperature range.

For a gas broil heating element, the BROIL_SET is reduced 6° F. from the values shown in Table 1 for the TARGET_TEMP for the HIGH temperature band. The broil gas element is turned OFF for the MID and the LOW temperature bands. The heat output of the bake gas element is turned off because the gas bake heating element can supply sufficient heat to maintain the cooking chamber within the desired temperature ranges. All things being equal, the gas elements normally output a greater amount of heat than the electric elements.

Although not shown in Table 2, in addition to the change in the BROIL_SET parameter, it is preferred that the duty cycle, as represented by the BROIL_ON parameter of Table 1, is reduced by a predetermined amount, preferably approximately 50%, for both the electric and gas broil heating elements and for all of the temperature bands (HIGH, MID, and LOW). For example, as shown in Table 1, the BROIL_ON time for the 350° F. TARGET_TEMP is 35 seconds for a cycle time of 60 seconds for the BAKE cycle. When the CHOICE BAKE cycle is selected, the BROIL_ON time is reduced approximately 50% to about 17 seconds. The reduction of the duty cycle necessarily results in a corresponding reduction in the top heat.

The turning OFF of the broil heating element can be accomplished in many different ways. For example, the BROIL_ON parameter can be set to 0, which would prevent the broil heating element from turning on. Alternatively, the controller, which is already pre-programmed with whether the broil heating element is gas or electric, can detect the selection of the CHOICE BAKE cycle and then check to see if the TARGET_TEMP is in one of the temperature ranges (HIGH, MID, and LOW) that requires the broil heating element to be turned off and then shuts off power to the broil heating element as long as the CHOICE BAKE cycle is selected.

While it is preferred that, upon the selection of the CHOICE BAKE cycle, the top heat is reduced by both reducing the value for the BROIL_SET parameter and the value for the BROIL_ON time, it is within the scope of the invention to reduce the value of only one of the parameters.

The CHOICE BAKE cycle as described represents a substantial improvement in the browning performance of an oven dual-element oven. The reduction of top heat associated with the activation of the CHOICE BAKE cycle provides for the more traditional browning effect while taking advantage of the more even temperature distribution associated with the dual-element oven.

Another advantage of the CHOICE BAKE cycle is that it can be turned on and off as desired by the user. Since the CHOICE BAKE cycle is implemented by changing the standard values for the BROIL_ON and BROIL_SET parameters of the standard BAKE cycle, the user can easily switch between the two cycles. For example, if the user begins by selecting the BAKE cycle and then decides that too much browning is occurring, say by observing the food item, the user can press the CHOICE BAKE button to activate the CHOICE BAKE cycle. If the user starts by selecting the CHOICE BAKE cycle and then decides that more browning is needed, the user can select the BAKE cycle by selecting the BAKE button. It is within the scope of the invention for the CHOICE BAKE button to work as a toggle. If the CHOICE BAKE cycle is already selected and the Choice Bake button is selected, the controller switches from the CHOICE BAKE cycle to the BAKE cycle by replacing the values of Table 2 with the values of Table 1. Another selection of the CHOICE BAKE button will result in the controller switching from the BAKE cycle back to the CHOICE BAKE cycle by using the values of Table 2 for the BROIL_ON and BROIL_SET.

The ability to turn the CHOICE BAKE cycle off and on as the user sees fit is greatly beneficial to the user. It lets the user manually control the amount of browning based on the user's baking experience without fundamentally changing the underlying baking cycle. That is, the browning can be controlled as desired without changing the bake time or the bake temperature required to properly cook the food item. With the invention, the user can have a perfectly cooked and browned cake.

In the preferred embodiment, dual sensors are used to individually sense the baking cavity temperature near each of the heating elements since this yields the greatest accuracy. However, it is within the scope of the invention for a single temperature sensor to be used. The invention is useful whenever the broil heating element is used during the standard bake cycle regardless of the number of temperature sensors.

While it is anticipated that the primary use of the invention will be to reduce the top heat to improve the browning performance of the oven, it is also within the scope of the invention to use the CHOICE BAKE option to increase the top heat. Since the user is now being given control over the top heat, it is anticipated that some users will likely underestimate the amount of top heat and needed for proper browning and leave the CHOICE BAKE cycle on too long, resulting in the inability to apply sufficient top heat by the end of the baking time to obtain the desired browning. There may also be an occasion where additional top heat is desired without any prior reduction in the top heat.

Thus, the users can be given the option to use the CHOICE BAKE button to increase the top heat. This can easily be done in many different ways. The CHOICE BAKE button can be a three position switch, with one position corresponding to increased top heat, another to reduced top heat, and a third to the top heat provided by the predetermined protocol. The switch could even be a four position that also provided for completely turning off the top heat. However, it is more desirable to implement this in the protocol for the reduced top heat. Multiple switches could be used instead of a single switch. Also, a top heat control knob could be used having positions corresponding to reduced or increased top heat.

The increasing of the top heat can be implemented in the same manner as the reducing of the top heat previously described. That is the set point can be increased or the duty cycle increased. The amount of the increases will depend on the particular output of the broil heating element, just like the reduction values. The increase in these values can also be a function of the bake temperature, just like the reduction values.

While the invention has been specifically described in connection with certain specific embodiments thereof, it is to be understood that this is by way of illustration and not of limitation, and the scope of the appended claims should be construed as broadly as the prior art will permit.

What is claimed is:

1. An oven for baking food according to a bake cycle having user selected time and temperature parameters, the oven comprising:

a housing defining an open-face baking cavity formed by opposing top and bottom walls, opposing side walls extending between the top and bottom walls, and a rear wall opposing the open face;

a door movably mounted to the housing for movement between an opened and a closed position to selectively close the baking cavity open face;

a bake heating element positioned adjacent the bottom wall for introducing bottom heat into the baking cavity;

a broil heating element positioned adjacent the top wall for introducing top heat into the baking cavity; and a controller for controlling the activation of the broil heating element by cycling the broil heating element ON and OFF to implement the bake cycle and having a user-operable switch, the selection of which increases or decreases the top heat radiated by the broil heating element while the switch is selected and the deselection of the switch terminates the reduced top heat, to thereby permit the user to selectively control the top heat and the browning performance of the oven.

2. The oven according to claim 1 wherein the controller controls the activation of the broil and bake heating elements by cycling the broil and bake heating elements ON and OFF according to a predetermined protocol to implement the bake cycle according to the user-selected time and temperature, and the selection of the user-operable switch reduces or increases the cumulative top heat radiated by the broil heating element relative to the cumulative top heat outputted according to the predetermined protocol.

3. The oven according to claim 2 wherein the selection of the user-operable switch reduces or increases the overall time that the broil heating element is ON relative to overall time the broil heating element is ON according to the predetermined protocol.

4. The oven according to claim 3 wherein the deselection of the user-operable switch returns the top heat radiated by the broil heating element to that determined by the predetermined protocol.

5. The oven according to claim 4 wherein the deselection of the user-operable switch returns the cumulative time that the broil heating element is on to the time determined by the predetermined protocol.

6. The oven according to claim 2 wherein the predetermined protocol comprises at least one parameter for controlling the activation of the broil and heating elements and the selection of the user-operable switch alters the at least one parameter to reduce or increase the cumulative top heat radiated by the broil heating element.

7. The oven according to claim 6 wherein the at least one parameter is a temperature set point having an initial value at which the broil heating element is turned ON and the selection of the user-operable switch reduces or increases the temperature set point from the initial value.

8. The oven according to claim 7 wherein the deselection of the user-operable switch returns the temperature set point to its initial value.

9. The oven according to claim 7 wherein the at least one parameter is a duty cycle having an initial value and the selection of the user-operable switch reduces or increases the initial value of the duty cycle.

10. The oven according to claim 9 wherein the deselection of the user-operable switch returns the duty cycle to its initial value.

11. The oven according to claim 6 wherein the at least one parameter is a duty cycle having an initial value and the selection of the user-operable switch reduces or increases the initial value of the duty cycle.

12. The oven according to claim 11 wherein the deselection of the user-operable switch returns the duty cycle to its initial value.

13. The oven according to claim 2 and further comprising a first temperature sensor coupled to the controller and positioned within the baking cavity near the broil heating element for sensing a localized baking cavity temperature near the broil heating element and a second temperature sensor coupled to the controller and positioned within the baking cavity near the bake heating element for sensing a localized baking cavity temperature near the bake heating element, whereby the controller independently controls the actuation of the broil and bake heating elements based on their localized temperatures.

14. The oven according to claim 13 wherein the predetermined protocol comprises a broil temperature set point and a bake temperature set point, wherein when the localized broil temperature is less than the broil temperature set point, the controller actuates the broil heating element, and when the localized bake temperature is less than the bake temperature set point, the controller actuates the bake heating element.

15. The oven according to claim 14 wherein the selection of the user-operable switch reduces or increases the value of the broil temperature set point.

16. The oven according to claim 15 wherein the deselection of the user-operable switch returns the temperature set point to its prior value.

17. The oven according to claim 16 wherein the selection of the user-operable switch reduces or increases the duty cycle for the broil heating element.

18. The oven according to claim 17 wherein the deselection of the user-operable switch returns the duty cycle to its prior value.

19. A method for controlling the browning performance of an oven comprising a baking cavity having a broil element positioned near a top wall of the oven cavity for radiating top heat into the baking cavity, a bake element positioned near a bottom wall of the baking cavity for radiating bottom heat into the baking cavity, and a controller for actuating the bake and broil heating elements ON and OFF, the method comprising:

implementing a baking cycle that maintains the temperature of the baking cavity at a predetermined bake temperature by controlling the cycling ON and OFF of the bake and broil heating elements; and selectively reducing or increasing the cumulative top heat radiated by the broil heating element for at least part of the bake cycle in response to a user input.

20. The method of claim 19 wherein the top heat is reduced or increased for the entire bake cycle in response to the user input.

21. The method of claim 19 wherein the predetermined bake temperature is selected by the user.

22. The method of claim 19 wherein the implementing of the bake cycle comprises setting a broil temperature set point corresponding to the predetermined bake temperature.

23. The method of claim 22 wherein the controller sets the broil temperature set point.

24. The method of claim 22 wherein the selective reducing or increasing of the top heat comprises reducing or increasing, respectively, the broil temperature set point.

25. The method of claim 24 wherein the implementing of the bake cycle comprises setting a duty cycle for the broil heating element based on the predetermined bake temperature.

26. The method of claim 25 wherein the duty cycle varies as a function of magnitude of the predetermined bake temperature.

27. The method of claim 26 wherein the predetermined bake temperature is limited to at least two temperature ranges.

28. The method of claim 27 wherein the duty cycle varies as a function of the temperature range.

29. The method of claim 28 wherein the reduction of the broil temperature set point varies as a function of the temperature range.

30. The method of claim 29 wherein the reduction of the broil temperature set point includes reducing the broil temperature set point such that the broil heating element is not turned ON during the selective reduction of top heat.

31. The method of claim 19 wherein the implementing of the bake cycle comprises setting a duty cycle for the broil heating element based on the predetermined bake temperature.

32. The method of claim 31 wherein the duty cycle varies as a function of magnitude of the predetermined bake temperature.

33. The method of claim 32 wherein the predetermined bake temperature is limited to at least two temperature ranges.

34. The method of claim 33 wherein the duty cycle varies as a function of the temperature range.

35. The method of claim 19 wherein the user input comprises the selection of a switch coupled to the controller by the user.

36. An oven for baking food according to a bake cycle having user selected time and temperature parameters, the oven comprising:

a housing defining a baking cavity;

a bake heating element positioned adjacent a lower portion of the baking cavity for introducing bottom heat into the baking cavity;

a broil heating element positioned adjacent an upper portion of the baking cavity for introducing top heat into the baking cavity; and a control panel comprising a bake mode selector for selecting the desired bake mode, a bake temperature selector for selecting the desired baking temperature, a bake time selector for selecting the desired bake time, and a top heat adjustment selector for adjusting the top heat relative to the amount of top heat determined by the selected bake mode.

37. The oven according to claim 36 wherein the selection of the top heat adjustment selector on the control panel increases or decreases the outputted top heat relative to the outputted top heat according to the selected bake mode.

38. The oven according to claim 37 wherein the selection of the top heat adjust selector alters at least one parameter of the selected bake mode.

39. The oven according to claim 38 wherein the at least one parameter comprises at least one of a temperature set point and a duty cycle.

40. The oven according to claim 39 wherein the temperature set point is a localized set point for the broil heating element.

41. The oven according to claim 36 wherein the top heat adjustment selector is a switch.

42. The oven according to claim 41 wherein the switch is a button.

43. The oven according to claim 36 wherein the top heat adjustment selector is a knob.

44. The oven according to claim 43 wherein the bake mode selector is a knob.

45. The oven according to claim 44 wherein the same knob is used for the top heat adjustment selector and the bake mode selector.

* * * * *